US008684076B2

(12) United States Patent
Kostrov et al.

(10) Patent No.: US 8,684,076 B2
(45) Date of Patent: Apr. 1, 2014

(54) METHOD AND APPARATUS FOR ENHANCEMENT OF FRACTURE FLUID CLEAN-UP WITH PERIODIC SHOCK WAVES

(76) Inventors: Sergey A Kostrov, Dallas, TX (US); William O Wooden, Plano, TX (US)

( * ) Notice: Subject to any disclaimer, the term of this patent is extended or adjusted under 35 U.S.C. 154(b) by 449 days.

(21) Appl. No.: 12/932,225

(22) Filed: Feb. 22, 2011

(65) Prior Publication Data

US 2012/0211225 A1 Aug. 23, 2012

(51) Int. Cl.
*E21B 28/00* (2006.01)

(52) U.S. Cl.
USPC ..... 166/249; 166/177.1; 166/177.2

(58) Field of Classification Search
USPC ..... 166/249, 177.1, 177.2
See application file for complete search history.

(56) References Cited

U.S. PATENT DOCUMENTS 2,057,859 A * 10/1936 Thaheld ..... 92/247
5,586,602 A * 12/1996 Vagin ..... 166/249
6,899,175 B2 * 5/2005 Kostrov et al. ..... 166/249

* cited by examiner

*Primary Examiner* — Giovanna Wright

(57) ABSTRACT

The method and apparatus for enhancing fluid removal from a fracture in a geologic formation by applying periodic/cyclic shock waves to the fracture in a formation surrounding a wellbore which has undergone fracturing. In accordance with the invention, the method includes the steps of arranging a device attached to an end of a tubing string inside a wellbore in a vicinity of said fracture for generating shock waves, providing a liquid via the tubing string into the device for generating shock waves with the amplitude $P_a$ of shock waves determined by a following expression:

$$0.3\ \text{MPa} \le P_a \le 1.4P_p - 0.8\rho gH,$$

where $P_p$ is a formation pore pressure, ρ is a formation density, g is a gravity acceleration, H is a depth of said fracture, $P_a$ is an amplitude of the shock wave.

4 Claims, 2 Drawing Sheets

METHOD AND APPARATUS FOR ENHANCEMENT OF FRACTURE FLUID CLEAN-UP WITH PERIODIC SHOCK WAVES

BACKGROUND OF THE INVENTION

The present invention relates to hydrocarbon well stimulation and in particular to methods and apparatus to mobilize and remove fracturing fluids introduced into a fracture zone and surrounding porous media by means of applying periodic shock waves.

BRIEF DESCRIPTION OF PRIOR ART

Fracturing the earth from a wellbore is a known technique for enhancing oil production and recovery from an oil bearing bed. A variety of methods have been proposed to create both short and long fractures near a wellbore. However hydraulic fracture treatments oftentimes underperform. In such cases a so-called Frac and Pack completions shows a difference between the designed and effective fracture length. This is due to creation of a positive skin effect caused in part by stagnant fluids (for instance polymers) retained in the fracture tip and fracture faces limiting hydrocarbon production (both in rate and capacity) from a given well. Numerous technologies have been developed to provide skin removal and fracture clean-up of such stagnant fluids.

One of these methods is described and claimed in U.S. Pat. No. 6,069,118 wherein a well stimulation method coupled with methods and compositions to remove fluid introduced into a subsurface fracture are presented. In this patent methods are given to create then exploit chemical potential gradients at the fracture face to induce a fluid flow from the fracture into the formation thereby increasing effective fracture length and improving fracture conductivity. In another patent (U.S. Pat. No. 7,723,264), herein incorporated by reference, methods to increase recovery of treatment fluid following stimulation of a subterranean formation using cationic surfactant coated particles are disclosed. These approaches provide the basis for numerous inventions as disclosed in U.S. Pat. Nos. 5,806,597; 5,875,843; 5,960,880; 5,964,289; and 6,439,309, herein incorporated by reference. Presently, a primary method for removal of stagnant fluids is a breaker fluid which is pumped into the fracture to lower a viscosity of the stagnant fluids so they are more easily removed from the fracture during a flowback. The main disadvantage of all above noted methods is the problem of delivering the breaker fluid deep enough into the fracture to provide the effective breaker action on stagnant fluids under the existing pressure gradient. One approach to resolve this problem is a use of vibrations or shock waves to increase the mobility of the breaker fluid in the fracture thereby enhancing the process of fracture clean-up. One method for increasing fluid mobility is disclosed in U.S. Pat. No. 6,467,542, herein incorporated by reference, wherein high frequency vibrations are used for treatment of a near well zone to remove the skin effect. The disadvantage of this method is a high attenuation of high frequency vibrations in porous medium, limiting the distance over which they are effective. The use of shock waves for increasing oil mobility/recovery is disclosed in U.S. Pat. No. 6,899,175 and U.S. Pat. Nos. 125,783 and 140,004, herein incorporated by reference.

While there have been a variety of methods proposed for cleaning-up fractures around the wellbore, there remains a need for an economical method which provides effective clean-up of fractures.

SUMMARY OF THE INVENTION

Accordingly, a primary object of the present invention is to provide a method for enhancing fluid removal from the fracture in a geologic formation by applying periodic/cyclic shock waves to fluids in the fracture and to a surrounding formation which has undergone fracturing. In accordance with the invention, the method includes the steps of arranging a device attached to an end of a tubing string inside a wellbore in a vicinity of said fracture for generating shock waves, providing a liquid via the tubing string into the device for generating shock waves with an amplitude $P_a$ of shock waves determined by a following expression:

$$0.3\ \text{MPa} \le P_a \le 1.4P_p - 0.8\rho gH,$$

where $P_p$ is a formation pore pressure, $\rho$ is a formation density, g is a gravity acceleration, H is a depth of said fracture, $P_a$ is the amplitude of shock wave;

It is further object of the present invention to provide the method for enhancing of fluid removal from the fracture in a geologic formation in which the device for generating shock waves includes a flow line at the surface supplying the liquid from a breaker tank via a pump into a wellbore and the flow line having a check valve, similar to the one described for instance in U.S. Pat. No. 6,899,375, preventing flow of the liquid from the wellbore back into the flow line, a tubing string connected to the flow line and extending downwardly into the wellbore, an elongated cylinder connected to the bottom of the tubing string at the upper end and having an opening to wellbore, a plunger movably arranged within an elongated cylinder to move within the elongated cylinder, a pumping means connected with the plunger for moving of the plunger within the elongated cylinder and compressing the liquid contained between said check valve inside the flow line and the plunger inside the elongated cylinder and discharging said liquid into the wellbore via the opening when the plunger exits out of the elongated cylinder on every upstroke of the pumping means to generate the shock wave, a lubricator accommodating the pumping means to prevent a leakage of liquid from the tubing and flow line at the surface, and said pumping means upward motion length $L_p$ on every upstroke is determined by the following formulae:

$$L_p = \frac{4P_a V_t\left(1 - \frac{P_t - P_c}{\beta\varphi}\right)}{\pi\beta\varphi D_p},$$

where $L_p$ is a length of upstroke of the pumping means, $P_a$ is a required amplitude of the shock wave, $V_t$ is a volume of liquid contained between the check valve inside the flow line and the plunger inside the tubing string, $\pi$ equals 3.1415, $\beta$ is a bulk modulus of pure water, $\phi$ is a coefficient accounting the difference in compressibility between pure water and the liquid contained between the check valve inside the flow line and the plunger inside the elongated cylinder, $D_p$ is a diameter of the plunger, $P_t$ is the pressure of the liquid inside the tubing string, $P_c$ is the pressure of the liquid inside the wellbore.

It is further object of the present invention to provide an apparatus for enhancing of fluid removal from a fracture in the geologic formation comprising: the flow line at the surface supplying the liquid into wellbore, the tubing string connected with the flow line and extending downwardly into the wellbore, the elongated cylinder connected to the bottom of the tubing string at an upper end and having at least one opening into the wellbore on a side surface of the elongated cylinder, the plunger movably arranged within said elongated cylinder to move within said elongated cylinder, said plunger includes a lower portion having the diameter greater than upper portion of plunger, a spring installed between said lower portion of the plunger and a bottom of the elongated cylinder and said spring undergoes a compression displacement when the pressure inside the tubing string exceeds the pressure in the wellbore causing the lowering of the plunger inside the elongated cylinder and the discharging of the liquid contained inside the tubing string into the wellbore via at least one said opening as far as a top of the lower portion of moving downward plunger reaches at least one said opening thereby generating a shock wave, then said spring returns to its initial position as far as the liquid pressure inside the tubing string equalizes with the wellbore liquid pressure and the process repeats itself as an auto-oscillation regime with a frequency of auto-oscillations in accordance with the formulae:

$$\omega = \sqrt{\frac{Z}{M} - \frac{\lambda^2}{4M^2}},$$

where ω is the frequency of auto-oscillations, Z is a spring constant, M is a weight of the plunger and λ is a coefficient of friction between the lower portion of the plunger and the elongated cylinder.

It is another object of the present invention to provide an apparatus for enhancing of fluid removal from a fracture in the geologic formation in which said spring has the spring constant Z determined in accordance with the following formulae:

$$Z = \frac{\pi D_p (P_t - P_c)}{1 - \frac{D_o^2}{D_p^2}}$$

where Z is the spring constant, π equals 3.1415, $D_p$ is the diameter of the lower portion of the plunger, $D_o$ is the diameter of the upper portion of the plunger, $P_t$ is the pressure of the liquid inside the tubing string, $P_c$ is the pressure of the liquid inside the wellbore.

DETAILED DESCRIPTION

Figure 1:
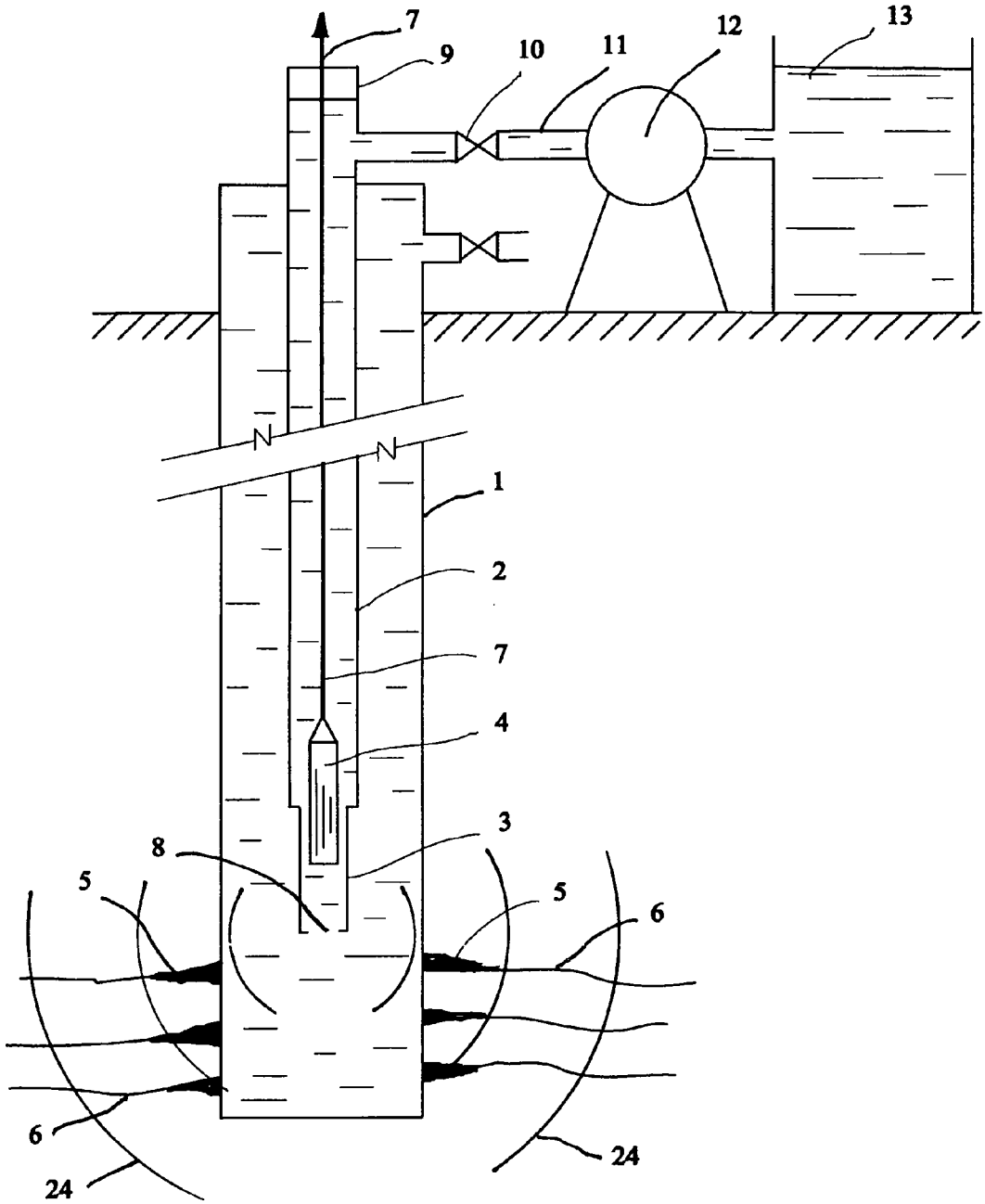
FIG. 1 shows a schematic illustration of the wellbore in which the apparatus and the method of the present invention is employed.

Referring to FIG. 1, there is shown the wellbore 1 having perforations 5 and fractures 6 with a proppant and a stagnant fluid residing in the fracture 6. The stagnant fluid must be degraded which requires the highly viscous polymers to be broken and the stagnant fluid mobilized and removed, otherwise a gel inside the fracture 6 can detrimentally impede the flow of fluid from the formation into the wellbore 1. Removal of this gel requires a polymer breaking mechanism to be implemented. Liquids called breakers are typically injected into the fracture 6 to accelerate breaking the polymer. Those chemicals cleave the cross-linked polymer molecules into smaller pieces of lower molecular weight. FIG. 1 shows a general arrangement of a clean-up apparatus and procedure using the periodic/cyclic shock waves provided by the device for generating such shock waves comprising the flow line 11 at the surface supplying the liquid/breaker from the breaker tank 13 via the pump 12 into the wellbore 1, the check valve 10, like the one described for instance in U.S. Pat. No. 6,899,175, installed on the flow line 11 preventing the flow of liquid from the wellbore 1 back into the flow line 11, the tubing string 2 connected to flow line 11 and extending downwardly into the wellbore 1, the elongated cylinder 3 connected with the bottom of the tubing string 2 at the upper end and having the opening 8 to the wellbore 1, the plunger 4 movably arranged within the elongated cylinder 3 to move within elongated cylinder 3, the pumping means 7 connected with the plunger 4 for moving of the plunger 4 within the elongated cylinder 3 and compressing the liquid contained between the check valve 10 inside the flow line 11 and plunger 4 inside the elongated cylinder 3 and discharging the compressed liquid into the wellbore 1 via opening 8 when the plunger 4 exits out of the elongated cylinder 3 on every upstroke of the pumping means 7 to generate a shock wave 24. A lubricator 9 accommodates the pumping means 7 to prevent the leakage of the compressed liquid from the tubing string 2 and the flow line 11 at the surface. The generated shock waves 24 have the amplitude $P_a$ determined by the following expression:

$$0.3\ \text{MPa} \le P_a \le 1.4P_p - 0.8\rho gH,$$

where $P_p$ is the formation pore pressure, ρ is the formation density, g is the gravity acceleration, H is the depth of said fracture 6, $P_a$ is the amplitude of shock wave 24. In particular, for formation pore pressure $P_p$, the formation density ρ, gravity acceleration g and depth of formation H accounting for 45 MPa, 2300 kg/m$^3$, 9.81 m/s$^2$ and 3000 m, correspondingly, the amplitude of the generated shock waves 24 has to not exceed 33.6 MPa. The shock waves 24 propagating through the fracture(s) 6 enhance the process of clean-up by breaking the high molecular chains and enhancing the movement of breaker inside the fracture(s) 6 and in the formation thereby increasing the effective fracture length. The generation of shock waves 24 described above is based on classic hydro-impact phenomenon when compressed liquid contained between the check valve 10 inside the flow line 11 and the plunger 4 inside the elongated cylinder 3 is discharged into the wellbore 1 via opening 8 during a fraction of a second.

As an option of pumping means 7, a wire line or a string of a sucker rods connected to the pumping unit installed at the surface could be used. The length of pumping means upstroke $L_p$ to compress the liquid contained between the check valve 10 inside the flow line 11 and the plunger 4 inside the elongated cylinder 3 is determined by the following formulae:

$$L_p = \frac{4P_a V_t \left(1 - \frac{P_t - P_c}{\beta\varphi}\right)}{\pi\beta\varphi D_p},$$

where $L_p$ is the length of pumping means upstroke 7, $P_a$ is the required amplitude of the shock wave 24, $V_t$ is the volume of liquid contained between the check valve 10 inside the flow line 11 and the plunger 4 inside the tubing string 2, π equals 3.1415, β is a bulk modulus of pure water, ϕ is a coefficient accounting the difference in compressibility between pure water and the liquid/breaker contained between the check valve 10 inside the flow line 11 and the plunger 4 inside the elongated cylinder 3, $D_p$ is the diameter of the plunger 4, $P_t$ is the pressure of the liquid inside the tubing string 2, $P_c$ is the pressure of the liquid inside the wellbore 1. In particular, for $D_p$=0.06985 m, $P_a$=10 MPa, $V_t$=8.5 $m^3$, β=2.2*$10^9$ Pa, ϕ=0.8, $P_t$=12.5 MPa and $P_c$=12 MPa the length of upstroke $L_p$ accounts for 12 m.

Figures 2, 2A, 3:
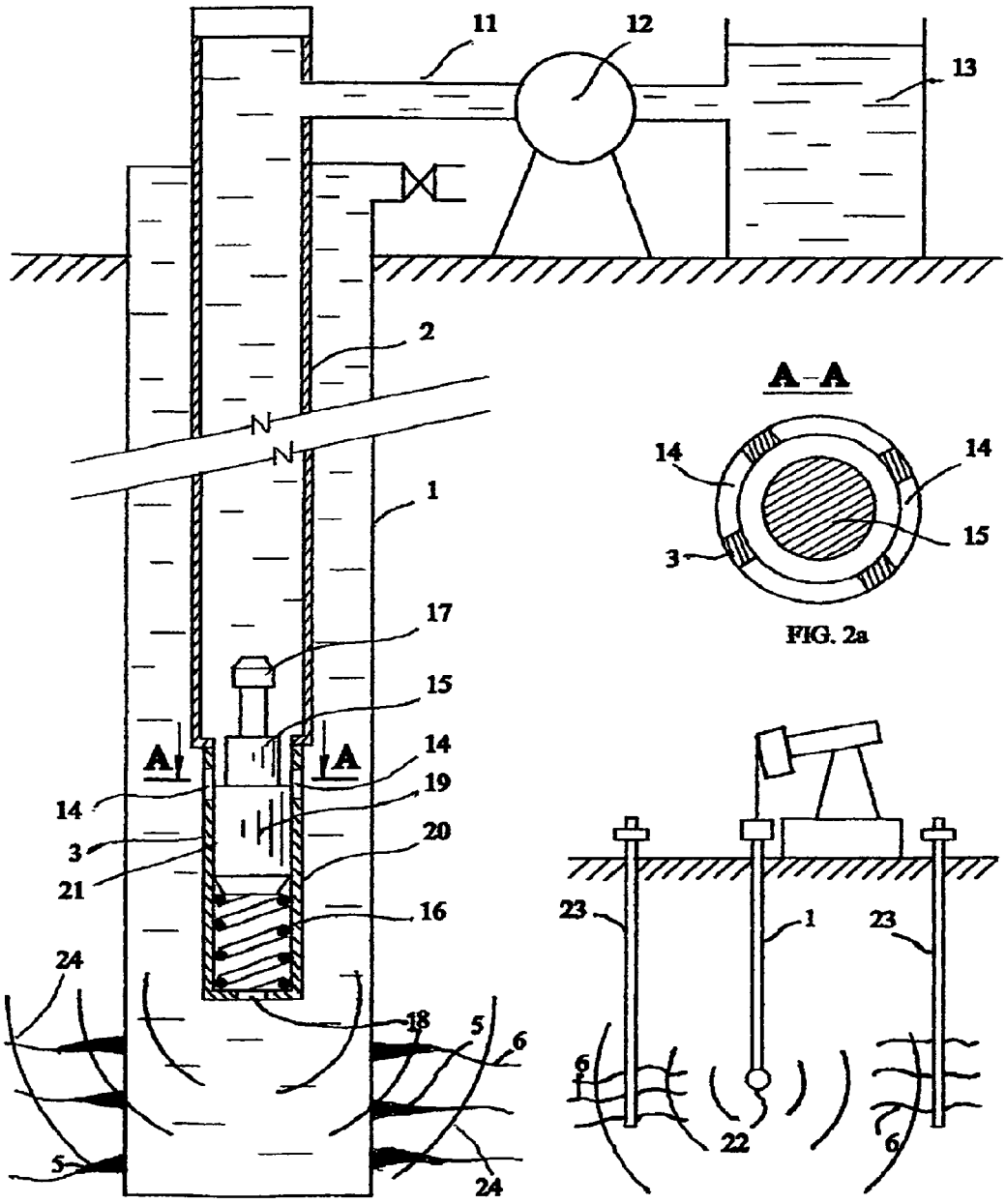
FIG. 2 is a cross-sectional side view of the alternative apparatus for practicing the present invention.
FIG. 2*a* is a cross-sectional top view of the tubing string having at least one opening and the upper part of the plunger.
FIG. 3 shows the schematic illustration of alternative method for practicing the present invention.

The generation of shock waves could be provided without using a pumping means. Referring to FIG. 2 and FIG. 2*a*, there is shown the device for generating shock waves comprising the flow line 11 at the surface supplying the liquid/breaker from the breaker tank 13 via a pump 12 into the wellbore 1, the tubing string 2 connected with the flow line 11 and extending downwardly into the wellbore 1, the elongated cylinder 20 connected to the bottom of tubing string 2 at its upper end and having at least one opening 14 into the wellbore 1 on the side surface of the elongated cylinder 20, the plunger 21 having the lower portion 19 with the diameter greater than diameter of the upper portion 15 of the plunger 21 and movably arranged within the elongated cylinder 20 to move within the elongated cylinder 20, the spring 16 installed between said lower portion 19 of the plunger and the bottom of the elongated cylinder 20.

The spring 16 undergoes a compression displacement when pressure inside the tubing string 2 exceeds the pressure in the wellbore 1 causing the lowering of the plunger 21 inside the elongated cylinder 20 and discharging of the liquid contained inside tubing string 2 into the wellbore 1 via said at least one opening 14 as far as the top of the tower portion 19 of the downward moving plunger 21 reaches at least one opening 14 thereby generating a shock wave, then spring 16 returns to its initial position as far as the liquid pressure inside the tubing string 2 equalizes with the liquid pressure in the wellbore 1 and the process repeats itself as the auto-oscillation regime with the frequency of auto-oscillations in accordance with the formulae:

$$\omega = \sqrt{\frac{Z}{M} - \frac{\lambda^2}{4M^2}},$$

where ω is the frequency of auto-oscillations, Z is the spring constant, M is the weight of the plunger 21 and λ is the coefficient of friction between the lower portion of plunger 19 and the elongated cylinder 20. In particular, for Z=163000 N/m, M=120 kg, and λ=350 kg/sec the frequency of auto-oscillations ω accounts for 36.8 Hz. The spring constant Z, in turn, is determined in accordance with the following formulae:

$$Z = \frac{\pi D_p (P_t - P_c)}{1 - \frac{D_o^2}{D_p^2}},$$

where Z is the spring constant, π equals 3.1415, $D_p$ is the diameter of the lower portion 19 of the plunger 21, $D_o$ is the diameter of the upper portion 15 of the plunger 21, $P_t$ is the pressure of liquid inside tubing string 2, $P_c$ is the pressure of the liquid inside the wellbore 1. In particular, for $D_p$=0.06985 m, $D_o$=0.03985 m, $P_t$=12.5 MPa and $P_c$=12 MPa the spring constant accounts for 163000 N/m.

The elongated cylinder 20 has also the opening 18 at its bottom to avoid the compressing of liquid below the plunger 21.

Plunger 21 can be installed and retrieved after clean-up procedure by means for instance of a wire-line or a slick-line technique using a corresponding fishing neck 17 at the top of plunger 21.

Referring to FIG. 3, there is shown the alternative method for enhancing of fluid removal from the fracture 6 in the geologic formation in which a device 22 for generating shock waves like the one described for instance in U.S. Pat. No. 6,899,175 is installed in the wellbore of at least one offset well 1 closest to the at least one well 23 wherein the fracture 6 is created.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. A method of enhancing fluid removal from a fracture in a geologic formation comprising the steps of:

a) arranging a device for generating shock waves and said device is attached to an end of a tubing string inside a wellbore in a vicinity of said fracture;

b) providing a liquid via said tubing string into said device for generating shock waves;

c) generating periodic shock waves with an amplitude $P_a$ determined by the following expression:

$$0.3\ \text{MPa} \le P_a \le 1.4P_p - 0.8\rho g H,$$

where $P_p$ is a formation pore pressure, ρ is a formation density, g is a gravity acceleration, H is a depth of said fracture, $P_a$ is the amplitude of shock wave.

2. A method as defined in claim 1, wherein the device for generating shock waves comprising:

a) a flow line at a surface supplying the liquid into the wellbore and said flow line has a check valve preventing a flow of liquid from the wellbore back into said flow line;

b) the tubing string connected to said flow line and extending downwardly into the wellbore;

c) an elongated cylinder connected to a bottom of the tubing string at an upper end and having an opening to the wellbore;

d) a plunger movably arranged within said elongated cylinder to move within said elongated cylinder;

e) a pumping means connected with said plunger for moving of said plunger within said elongated cylinder and compressing the liquid contained between said check valve inside the flow line and said plunger inside the elongated cylinder and discharging the compressed liquid into the wellbore via said opening when said plunger exits out of said elongated cylinder on every upstroke of said pumping means to generate a shock wave;

f) a lubricator accommodating a pumping means to prevent a leakage of the liquid from the tubing string and flow line at the surface;

g) and said pumping means having an upward motion length $L_p$ on every upstroke is determined by following formulae:

$$L_p = \frac{4P_a V_t \left(1 - \frac{P_t - P_c}{\beta\varphi}\right)}{\pi\beta\varphi D_p},$$

where $L_p$ is the upward motion length, $P_a$ is a required amplitude of shock wave, $V_t$ is a volume of liquid contained between check valve inside the flow line and plunger inside the elongated cylinder, π equals 3.1415, β is a bulk modulus of pure water, ϕ is a coefficient accounting the difference in compressibility between pure water and liquid contained between check valve inside the flow line and plunger inside the elongated cylinder, $D_p$ is diameter of plunger $P_t$ is a pressure of liquid inside tubing, $P_c$ is the pressure of liquid inside wellbore.

3. Apparatus for generating periodic shock waves in a wellbore, comprising:

a) a flow line at the surface supplying a liquid into the wellbore;

b) a tubing string connected to said flow line extending downwardly into the wellbore;

c) an elongated cylinder connected to the bottom of the tubing string at an upper end and having at least one opening into the wellbore on a side surface of said elongated cylinder;

d) a plunger movably arranged within said elongated cylinder to move within said elongated cylinder;

e) said plunger includes a lower portion having a diameter greater than an upper portion of plunger;

f) a spring installed between said lower portion of the plunger and the bottom of said elongated cylinder, said spring undergoes a compression displacement when pressure inside said tubing exceeds the pressure in the wellbore causing lowering of the plunger inside said elongated cylinder and discharging of the compressed liquid contained inside the tubing string into the wellbore via said at least one opening as far as a top of the lower portion of moving downward plunger reaches said opening thereby generating a shock wave, then said spring returns to an initial position as far as the liquid pressure inside said tubing string equalizes with the wellbore liquid pressure and the process is repeated as an auto-oscillation regime with a frequency of auto-oscillations in accordance with the formulae:

$$\omega = \sqrt{\frac{Z}{M} - \frac{\lambda^2}{4M^2}},$$

where ω is the frequency of auto-oscillations, Z is a spring constant, M is a weight of plunger and λ is a coefficient of friction between the lower portion of the plunger and the elongated cylinder.

4. Apparatus as defined in claim 3, wherein said spring has the spring constant Z determined in accordance with the following formulae:

$$Z = \frac{\pi D_p (P_t - P_c)}{1 - \frac{D_o^2}{D_p^2}},$$

where Z is the spring constant, π equals 3.1415, $D_p$ is a diameter of the lower portion of the plunger, $D_o$ is the diameter of the upper portion of the plunger, $P_t$ is a pressure of liquid inside the tubing string, $P_c$ is a pressure of liquid inside the wellbore.

* * * * *